US008269407B1

(12) United States Patent
Lee

(10) Patent No.: US 8,269,407 B1
(45) Date of Patent: Sep. 18, 2012

(54) COLD CATHODE FLUORESCENT LAMP FOR ILLUMINATION

(75) Inventor: Seung-pyo Lee, Incheon (KR)

(73) Assignee: Sang IL System Co., Ltd., Incheon (KR)

( * ) Notice: Subject to any disclaimer, the term of this patent is extended or adjusted under 35 U.S.C. 154(b) by 0 days.

(21) Appl. No.: 13/281,898

(22) Filed: Oct. 26, 2011

(51) Int. Cl.
*H01J 61/06* (2006.01)

(52) U.S. Cl. ..... 313/491; 313/631

(58) Field of Classification Search ..... None
See application file for complete search history.

(56) References Cited

U.S. PATENT DOCUMENTS

2002/0027412 A1* 3/2002 Yoshida et al. ..... 313/486
2003/0151350 A1* 8/2003 Xu ..... 313/485
2010/0102695 A1* 4/2010 Watanabe et al. ..... 313/15

* cited by examiner

*Primary Examiner* — Ashok Patel
(74) *Attorney, Agent, or Firm* — Staas & Halsey LLP

(57) ABSTRACT

Provided is a cold cathode fluorescent lamp (CCFL) that can be used as an illumination light source. The CCFL includes cold cathode electrodes disposed at both ends of a glass tube, a fluorescent layer being formed on an inner surface of the glass tube. Each of the cold cathode electrodes includes: a base metal connected to front ends of lead wires for connection with a power source; a helical wire coil formed by helically winding a tungsten or tungsten-alloy wire around a cup shape, the helical wire coil being connected to the base metal in a manner such that the helical wire coil is erected in a length direction of the glass tube; and an emitter-coated coil inserted in the helical wire coil and coated with an emitter for inducing emission of electrons.

4 Claims, 5 Drawing Sheets

COLD CATHODE FLUORESCENT LAMP FOR ILLUMINATION

CROSS-REFERENCE TO RELATED APPLICATIONS

This U.S. non-provisional patent application claims priority under 35 U.S.C. §119 of Korean Patent Application No. 10-2011-0069236, filed on Jul. 13, 2011, the entire contents of which are hereby incorporated by reference.

BACKGROUND

The present disclosure herein relates to a cold cathode fluorescent lamp (CCFL) for illumination, and more particularly, to a highly efficient, long-lifespan CCFL improved in tube current, optical efficiency, brightness, and lifespan for being used as an illumination light source in addition to conventional use as a backlight of a liquid crystal display, a scanning light source of a facsimile, an eraser lamp of a copier, etc.

In the related art, cold cathode fluorescent lamps (CCFLs) are used as light sources such as backlights of liquid crystal displays, scanning light sources of facsimiles, and eraser lamps of copiers, and necessary brightness levels for such devices can be obtained by applying only a tube current of about 4 to 4 mA to the CCLFs. Such a CCFL includes cup-shaped electrodes provided at both ends of a glass tube, and a fluorescent layer formed by applying a fluorescent material to the inner surface of the glass tube. Rare gas such as neon gas, argon gas, and xenon gas is filled in the glass tube together with a small amount of mercury, and the glass tube is sealed. If a high voltage is applied to the cup-shaped electrodes provided at both sides of the glass tube, a small number of electrons ionize the rare gas sealed in the glass tube, and secondary electrons are emitted from the cup-shaped electrodes as the ionized rare gas collide with the cup-shaped electrodes (this is called a glow discharge). The secondary electrons collide with the mercury, and as a result, the mercury emits ultraviolet rays toward the fluorescent layer formed on the inner surface of the glass tube. Then, the fluorescent material of the fluorescent layer emits visible light. At this time, a tube current of about 4 mA to 5 mA flows in the glass tube. However, a tube current of 10 mA or higher is necessary to increase the brightness of the CCFL to a level necessary for illumination.

In the related art, electrodes of a CCFL are formed into a cup shape to increase inner areas of the electrodes necessary for electron emission. In addition, such electrodes are mainly formed of nickel (Ni) because nickel (Ni) has a relative low melting point and can be easily machined into a desired shape such as a cup shape. However, nickel (Ni) or nickel alloys have high work functions and high sputtering coefficients. For this reason, cup-shape electrodes are formed of an Nb—Ni alloy or Y—Ni alloy for increasing the sputtering resistance of the cup-shaped electrodes. However, the lifespan of such cup-shaped electrodes is short due to sputtering if a tube current of 10 mA or higher is applied to the electrodes. Sputtering causes excessive heat generation at electrodes and largely decreases luminous efficacy. In addition, since a sputtering layer is formed on an inner surface of a glass tube due to sputtering, it is difficult to obtain a brightness level necessary for illumination if electrodes are sputtered. That is, electrodes formed of nickel (Ni) or a nickel alloy are not suitable for a CCFL having a tube current of 5 mA or higher, and thus it is difficult to use a CCFL including cup-shaped nickel or nickel-alloy electrodes as an illumination light source.

Furthermore, in the related, since electrodes having large area are preferred, the sizes of the electrodes are excessively increased. Large electrodes occupy large spaces in glass tubes, and thus spaces for positive columns are reduced to decrease luminous efficacy and energy efficiency. Therefore, it is difficult to use CCFLs as illumination light sources.

SUMMARY

The present invention is proposed to obviate the above-mentioned limitations arising when using a cold cathode fluorescent lamp (CCFL) as an illumination light source. For this, an object of the present invention is to provide an illumination CCFL including cold cathode electrodes that can be easily formed into a cup shape by using tungsten or a tungsten alloy having a low sputtering coefficient and a low work function.

Another object of the present invention to provide an illumination CCFL including short electrodes but capable of emitting very bright light.

Another object of the present invention is to provide an illumination CCFL on which two lead wires can be easily installed for compatibility with a socket for a typical hot cathode fluorescent lamp.

Another object of the present invention to provide an illumination CCFL requiring a low discharge sustaining voltage so that the lifespan of electrodes can be increased.

Another object of the present invention is to provide an illumination CCFL having a structure on which an emitter can be easily coated and retained.

Embodiments of the present invention provide a CCFL for illumination, the CCFL including cold cathode electrodes, wherein each of the cold cathode electrodes include: a base metal connected to front ends of lead wires for connection with a power source; a helical wire coil formed by helically winding a tungsten or tungsten-alloy wire around a cup shape, the helical wire coil being connected to the base metal in a manner such that the helical wire coil is erected in a length direction of the glass tube; and an emitter-coated coil inserted in the helical wire coil and coated with an emitter for inducing emission of electrons.

In some embodiments, the lead wires connected to the base metal may be two in number and may be electrically disconnected from each other at the base metal.

In other embodiments, the emitter-coated coil may be formed by forming a tungsten thin wire thinner than the helical wire coil and coating the thin wire with at least one emitter selected from cesium oxide, barium oxide, strontium calcium oxide, yttrium oxide, and magnesium oxide.

In still other embodiments, the emitter-coated coil may be formed by winding a tungsten thin wire thinner than the helical wire coil into a thin coil, winding the thin coil into a helical shape, and coating the thin coil with at least one emitter selected from cesium oxide, barium oxide, strontium calcium oxide, yttrium oxide, and magnesium oxide.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Hereinafter, exemplary embodiments will be described in more detail with reference to the accompanying drawings.

Figure 4:
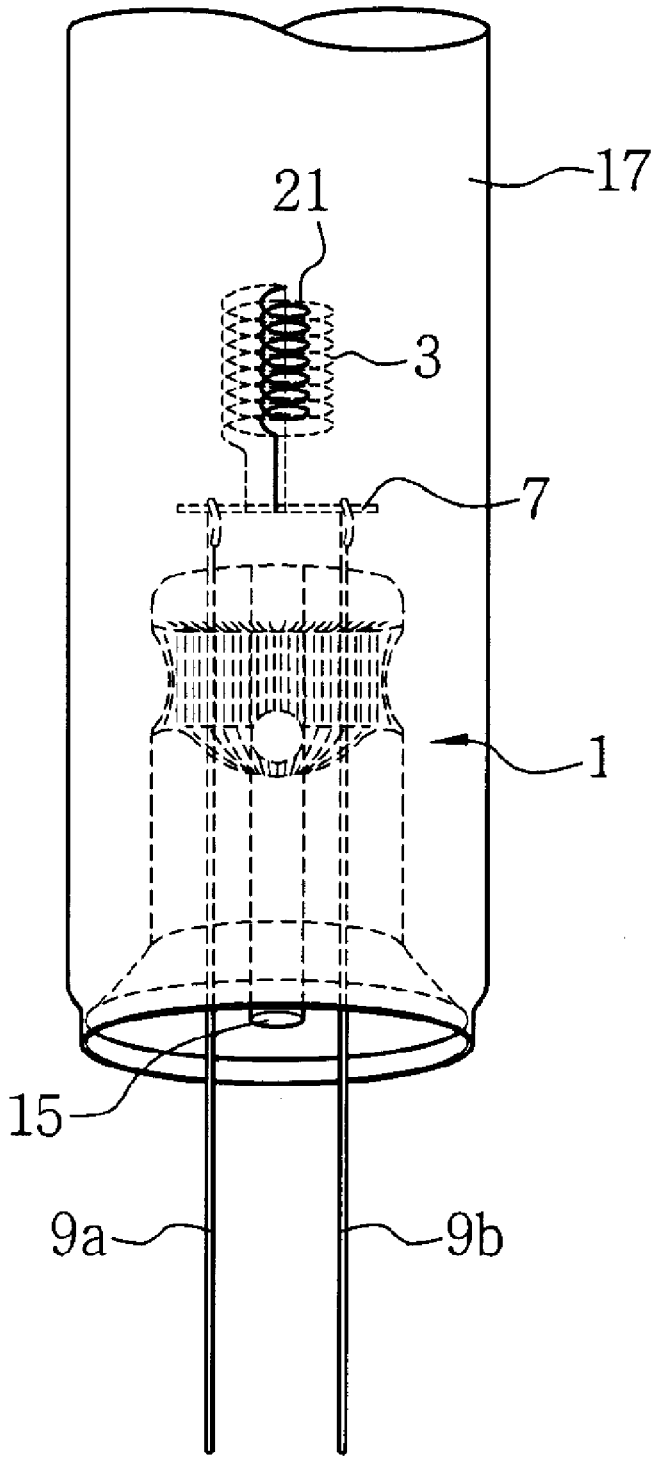
FIG. 4 is a partial perspective view illustrating the cold cathode electrode sealed in a glass tube according to the present invention.
Figure 5:
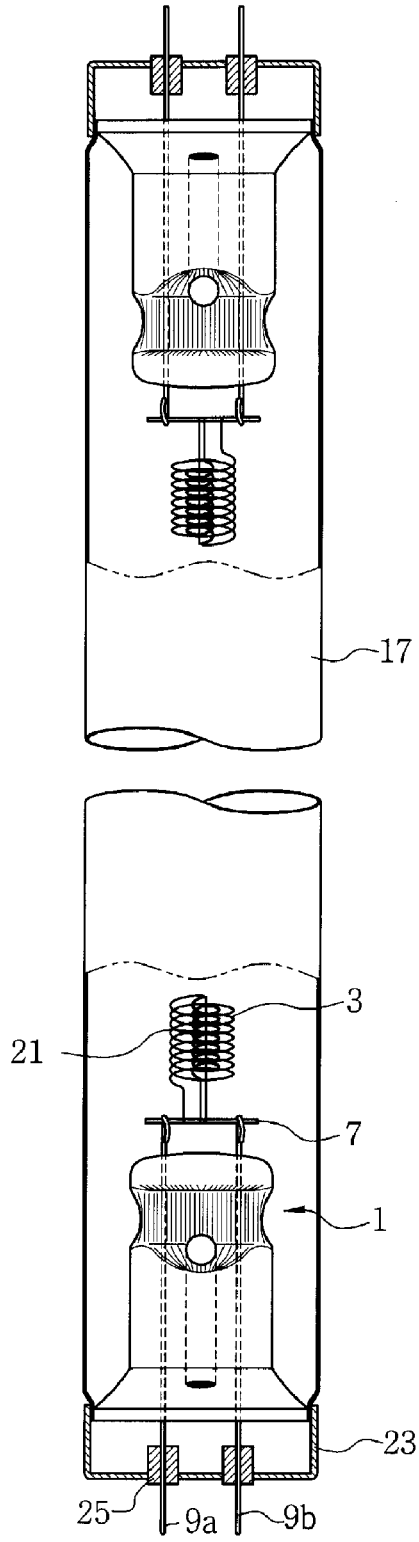
FIG. 5 is a partial sectional view illustrating a cold cathode fluorescent lamp (CCFL) for illumination according to the present invention.

Referring to FIGS. 4 and 5, a cold cathode fluorescent lamp (CCFL) is provided for using as an illumination lamp. The CCFL includes a pair of cold cathode electrodes 1 disposed at both ends of a glass tube 17, and the inner surface of the glass tube 17 is coated with a fluorescent layer. The cold cathode electrodes 1 have a low sputtering coefficient, a low firing voltage, and a low discharge sustaining voltage, but can emit a large amount of electrons. In the CCFL, the fluorescent layer is formed on the inner surface of the glass tube 17 by using a fluorescent material, and the cold cathode electrodes 1 are disposed at both ends of the glass tube 17 to face each other. If a high voltage is alternately applied to the cold cathode electrodes 1, electrons are emitted from the cold cathode electrodes 1. The cold cathode electrodes 1 of the present invention have satisfactory resistance against sputtering, a low discharge firing voltage, and a low discharge sustaining voltage so that a tube current can be increased to 10 mA or higher for emitting a large amount of electrons for the purpose of illumination. Therefore, the CCFL of the present invention can be used as an illumination light source.

An emitter-coated coil 21 which is characteristic element of the present invention will now be described with reference to FIG. 1.

Figure 1:
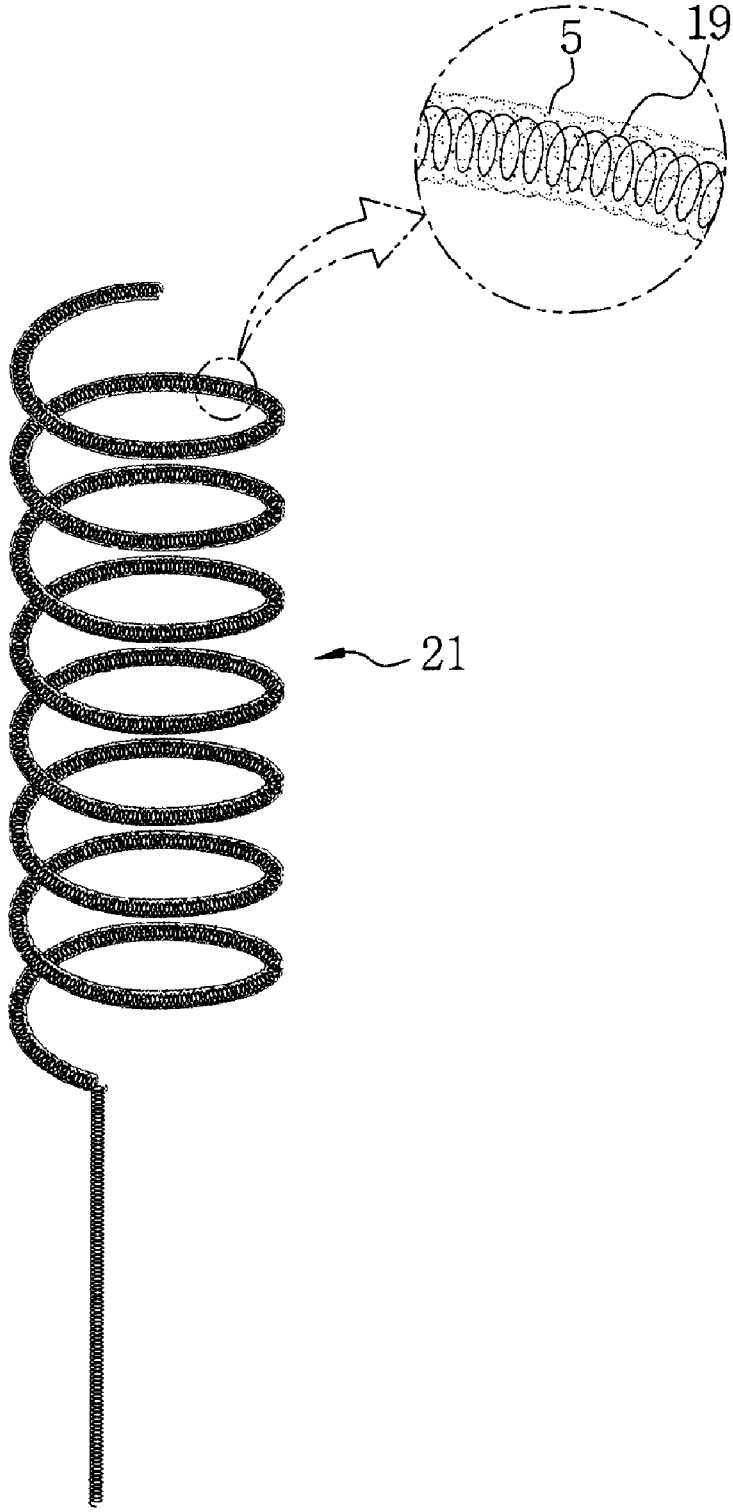
FIG. 1 is a perspective view illustrating an emitter-coated coil according to the present invention.

As shown in FIG. 1, the emitter-coated coil 21 of the present invention has an appropriate structure for applying a powder emitter 5 to the emitter-coated coil 21 and retaining the applied emitter 5. According an exemplary embodiment shown in FIG. 1, a thin wire coil 19 is formed of a tungsten thin wire (for example, having a diameter of 0.02 mm to 0.05 mm) which is thinner than a helical wire coil 3 (refer to FIG. 2) disposed around the emitter-coated coil 21, and then the thin wire coil 19 is wound in a helical shape to form the emitter-coated coil 21. The emitter 5 includes at least one of cesium oxide, barium oxide, strontium calcium oxide, yttrium oxide, and magnesium oxide in the form of powder. In the present invention, the emitter 5 is formed of a material having a low work function for easily emitting electrons. As a material has a low work function, the material can easily emit electrons. That is, the material can be easily discharged. Carbon nanotubes may be used to easily apply the emitter 5. In this case, a coating material may be prepared by dispersing carbon nanotubes in water and isopropyl alcohol while facilitating dispersion of the carbon nanotubes with sodium dodecylbenzenesulfonate (a surfactant). Owing to the above-described structure of the emitter-coated coil 21, the total length of the emitter-coated coil 21 can be increased as compared with the size of the emitter-coated coil 21, and thus electrons can be emitted in a small space to cause a tube current of 10 mA or higher. In addition, it may be easy to densely apply the emitter 5 to gaps among closely stacked turns of a thin wire of the thin wire coil 19. Furthermore, the emitter 5 can be stably retained on the thin wire coil 19 for a long time, and thus the lifespan of the cold cathode electrodes 1 can be increased.

The emitter-coated coil 21 may be formed by winding a tungsten or tungsten-alloy linear thin wire (for example, having a diameter of 0.02 mm to 0.05 mm) thinner than the helical wire coil 3 instead of forming the emitter-coated coil 21 using the thin wire coil 19. The thin wire may be coated with an emitter including at least one of cesium oxide, barium oxide, strontium calcium oxide, yttrium oxide, and magnesium oxide. In the case, however, it may be difficult to coat the thin wire with the emitter and the emitter may not be retained for a long time as compared with the case of using the thin wire coil 19.

Figure 2:
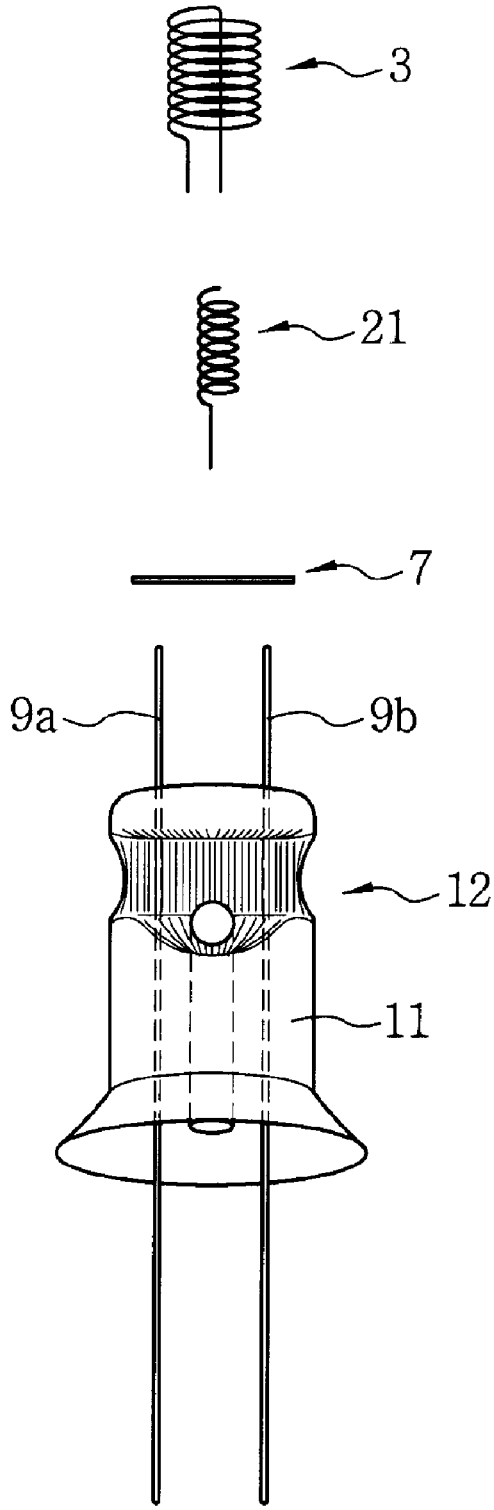
FIG. 2 is an exploded perspective view illustrating a cold cathode electrode according to the present invention.
Figure 3:
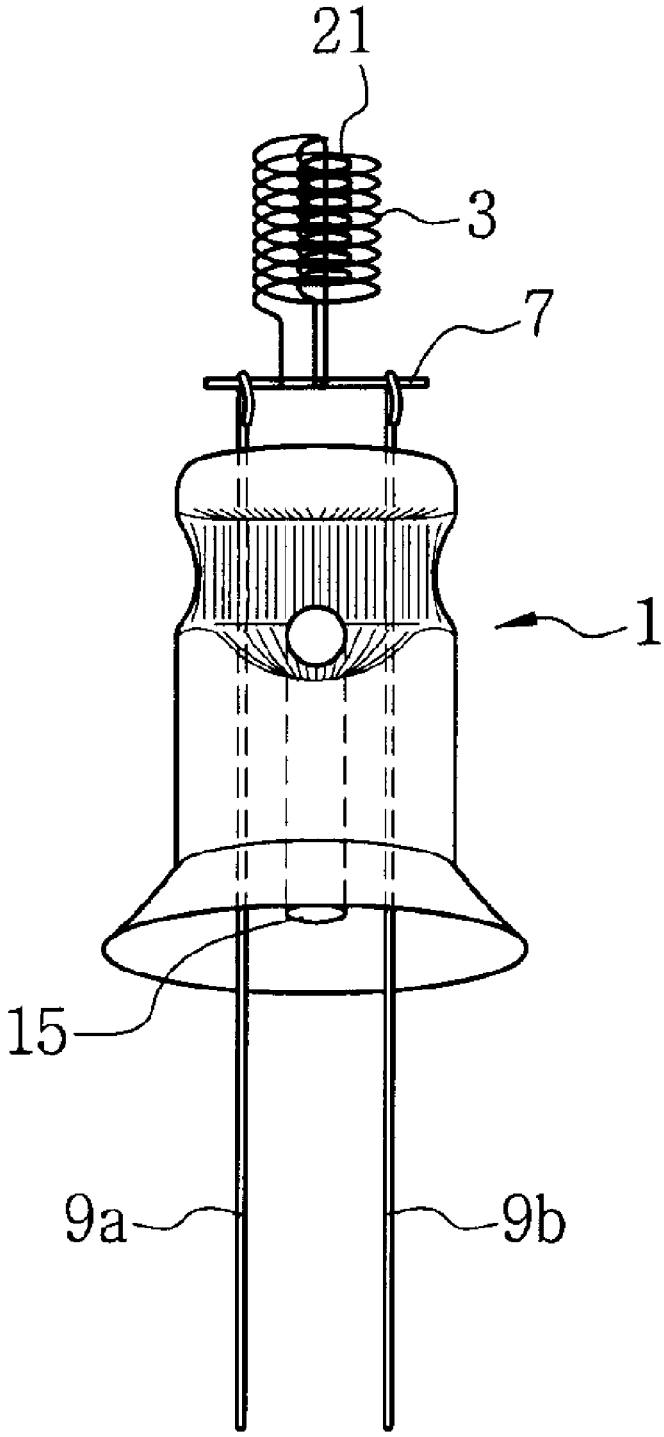
FIG. 3 is a perspective view illustrating the cold cathode electrode according to the present invention.

FIGS. 2 and 3 illustrate the helical wire coil 3 which is another characteristic element of the present invention. The helical wire coil 3 is formed by helically winding a tungsten or tungsten-alloy wire (having a diameter of 0.2 mm to 0.5 mm) around a cup shape. The helical wire coil 3 is connected to a base metal 7 in a manner such that the helical wire coil 3 is erected in the length direction of the glass tube 17. In each of the cold cathode electrodes 1 of the present invention, the base metal 7 is coupled to lead wires 9*a* and 9*b* connected to a power source. Dumet wires or Kovar wires are used as the lead wires 9*a* and 9*b*. The lead wires 9*a* and 9*b* are perpendicular to the base metal 7. The helical wire coil 3 is erected on the base metal 7 in a direction opposite to the lead wires 9*a* and 9*b*. In the present invention, owing to the base metal 7, two lead wires can be used. Therefore, a typical fluorescent lamp socket can be used with the CCFL of the present invention. Both ends of the helical wire coil 3 are firmly fixed to the base metal 7 so that the helical wire coil 3 can be erected in the length direction of the glass tube 17, and the lead wires 9*a* and 9*b* (Dumet or Kovar wires) can be easily connected to the helical wire coil 3 through the base metal 7. Therefore, the base metal 7 is made of a material that can be welded to both the helical wire coil 3 and the lead wires 9*a* and 9*b*. The base metal 7 may have a rod or bead shape. If the base metal 7 is made of tungsten or a tungsten alloy, the base metal 7 may not be welded to the helical wire coil 3 made of tungsten or a tungsten alloy due to the high melting point of tungsten. Therefore, the base metal 7 may be made of nickel or an nickel alloy. The helical wire coil 3 is electrically connected to a side of the base metal 7 by spot welding. The two lead wires 9*a* and 9*b* are connected to the base metal 7 in a state where the lead wires 9*a* and 9*b* are electrically disconnected from each other. The lead wires 9*a* and 9*b* extend in a direction opposite to the helical wire coil 3 and are connected to an external power source.

As shown in FIG. 2, both ends of the helical wire coil 3 may extend toward the base metal 7 in a manner such that one of both ends of the helical wire coil 3 extends from the topside of the helical wire coil 3 toward the base metal 7 through the helical wire coil 3, and the emitter-coated coil 21 may be inserted in the helical wire coil 3 around the end of the helical wire coil 3. In this case, the emitter-coated coil 21 may not be separated from the helical wire coil 3. An end of the emitter-coated coil 21 may be welded to the base metal 7 or not welded to the base metal 7. Referring to FIGS. 2 and 3, one emitter-coated coil 21 is disposed in the helical wire coil 3. However, another emitter-coated coil may be disposed in the emitter-coated coil 21, or two or more emitter-coated coils may be are closely arranged in the helical wire coil 3. Therefore, the cold cathode electrodes 1 can emit a large amount of electrons although a low voltage is applied to the cold cathode electrodes 1, and thus a brightness level necessary for illumination can be obtained without reducing the size of a positive column.

As shown in FIGS. 3 and 4, the lead wires 9*a* and 9*b* are coupled to a glass stem 11 by a glass beading method, and the glass stem 11 is coupled to the glass tube 17. In the glass beading method, the lead wires 9*a* and 9*b* of the cold cathode electrode 1, and a gas injection conduit 15 are inserted in the glass stem 11, and an upper part of the glass stem 11 is melted to fix the lead wires 9*a* and 9*b* and the gas injection conduit 15. After the glass beading method is performed, glass beads remain at coupled portions. In this way, gaps between the glass tube 17 and the lead wires 9*a* and 9*b* of the cold cathode electrode 1 can be easily sealed.

It is difficult to make a cup-shaped electrode by using tungsten or a tungsten alloy because tungsten or tungsten alloys are not easily machined into desired shapes through a plastic working process. However, it is easy to make tungsten or tungsten-alloy wires through a drawing process and wind the tungsten or tungsten-alloy wires into coils. A cup-shaped electrode having a low sputtering coefficient and a low work function can be made by stacking such coils having different diameters in multiple stages. The present invention is proposed based on this.

That is, according to the present invention, since the helical wire coil 3 is formed of tungsten or a tungsten alloy having a low sputtering coefficient and a low work function, the lifespan of the CCFL can be increased, and a discharge can be initiated with a low firing voltage. In addition, since the emitter-coated coil 21 is disposed in the helical wire coil 3, a discharge (electron emission) level necessary for illumination (10 mA or more) can be maintained with a low voltage in a stead state after the initial firing.

As shown in FIGS. 4 and 5, if a voltage is alternately applied to the cold cathode electrodes 1 of the CCFL, electrons are emitted from the cold cathode electrodes 1 by an electric field formed by the voltage. That is, since electrons are emitted by an electric field, heat is not necessary for electron emission. Initially, a small amount of electrons remaining in the glass tube 17 collide with the cold cathode electrodes 1, and then electrons are emitted from the cold cathode electrodes 1. The electrons emitted from the cold cathode electrodes 1 collide again with the cold cathode electrodes 1. In this way, the discharge (electron emission) continues. During the discharge, electrons moving to an anode collide with the mercury filled in the glass tube 17, and then ultraviolet rays are emitted from the mercury toward the fluorescent layer of the glass tube 17. Then, the fluorescent layer is optically excited and emits visible light. Since electrons can be easily emitted in the CCFL of the present invention, the CCFL can have high brightness and a long lifespan. In the present invention, the cold cathode electrodes 1 are formed of tungsten (W) having a high melting point as compared with a work function. Since it is difficult to machine tungsten (W), the cold cathode electrodes 1 are formed by drawing tungsten wires and winding the tungsten wires into helical coils. Electrons can be emitted from the helical coils. As described above, if an electrode is constituted by a densely wound helical tungsten coil having a sufficiently large diameter and an emitter-coated coil disposed in the coil, the electrode can have an electron emission area greater than that of a corresponding cup-shaped electrode. In an illumination lamp, energy of 10 eV or higher is necessary for electrons colliding with an electrode. Therefore, it may be necessary to form electrodes of an illumination CCFL by using tungsten (W). In addition, the electrode may be formed into a helical shape to increase an electron emission area of the electrode. However, although the tungsten electrode has a helical shape, the electrode may require a high discharge sustaining voltage and may emit a small amount of electrons. Thus, the electrode may not be used in an illumination device. However, according to the present invention, a helical wire coil is formed of tungsten, and an emitter-coated coil is disposed in the helical wire coil, so that a tube current of 10 mA or higher necessary for illumination can be obtained while keeping a discharge sustaining voltage at a low level.

As described above, according to the present invention, since the electrodes of the CCFL are formed of tungsten or a tungsten alloy and have a double-coil structure, the electrodes can have a high sputtering resistance even when a tube current is 10 mA or higher, and the CCFL can emit very bright light owning to a low work function of tungsten. In addition, the electrodes can emit a sufficient amount of electrons although the electrodes have short lengths. Furthermore, since the base metal is disposed between the helical wire coil and the lead wires, the lead wires can be easily installed for compatibility with a socket for a typical hot cathode fluorescent lamp. Furthermore, since the emitter-coated coil is used as an inner coil, secondary electrons can be emitted at a low voltage, and thus a discharge sustaining voltage can be reduced to increase the lifespan of the electrodes. Furthermore, since the inner coil is formed by winding a tungsten thin coil into a helical shape and coating the helically wound thin coil with an emitter, the emitter can be easily coated and stably retained on the inner coil.

What is claimed is:

1. A cold cathode fluorescent lamp (CCFL) for illumination, comprising cold cathode electrodes disposed at both ends of a glass tube, a fluorescent layer being formed on an inner surface of the glass tube, wherein each of the cold cathode electrodes comprise:

a base metal connected to front ends of lead wires for connection with a power source;

a helical wire coil formed by helically winding a tungsten or tungsten-alloy wire around a cup shape, the helical wire coil being connected to the base metal in a manner such that the helical wire coil is erected in a length direction of the glass tube; and an emitter-coated coil inserted in the helical wire coil and coated with an emitter for inducing emission of electrons.

2. The CCFL of claim 1, wherein the lead wires connected to the base metal are two in number and are electrically disconnected from each other at the base metal.

3. The CCFL of claim 1, wherein both ends of the helical wire coil extend toward the base metal in a manner such that an end of both ends of the helical wire coil extends from a topside of the helical wire coil toward the base metal through the helical wire coil, wherein the emitter-coated coil is disposed around the end of the helical wire coil.

4. The CCFL of claim 1, wherein the emitter-coated coil is formed by winding a tungsten thin wire thinner than the helical wire coil into a thin coil, winding the thin coil into a helical shape, and coating the thin coil with at least one emitter selected from cesium oxide, barium oxide, strontium calcium oxide, yttrium oxide, and magnesium oxide.

* * * * *